US006263522B1

(12) United States Patent
Dongo et al.

(10) Patent No.: US 6,263,522 B1
(45) Date of Patent: Jul. 24, 2001

(54) HYDROTHERAPY JET WITH AN EXTENDABLE/RETRACTABLE OUTLET

(75) Inventors: Paul A. Dongo; Sheldon Denst, both of Camarillo, CA (US)

(73) Assignee: Waterway, Inc., Oxnard, CA (US)

( * ) Notice: Subject to any disclaimer, the term of this patent is extended or adjusted under 35 U.S.C. 154(b) by 0 days.

(21) Appl. No.: 09/448,381

(22) Filed: Nov. 23, 1999

(51) Int. Cl.[7] ..... A61H 33/04
(52) U.S. Cl. ..... 4/541.6; 239/281; 239/587.4
(58) Field of Search ..... 4/492, 541.6, 541.2, 4/541.3, 541.4, 541.5; 239/539, 581.2, 205, 281, 587.4

(56) References Cited

U.S. PATENT DOCUMENTS

| | | | | |
|---|---|---|---|---|
| 4,371,994 | * | 2/1983 | Mathews | 4/492 X |
| 4,901,926 | * | 2/1990 | Klotzbach | 4/541.4 X |
| 4,915,312 | * | 4/1990 | Hiemstra | 239/229 |
| 5,095,558 | * | 3/1992 | Howard | 4/541.6 |
| 5,269,029 | | 12/1993 | Spears et al. | 4/541.6 |
| 5,848,444 | * | 12/1998 | Christopherson | 4/541.6 |
| 6,131,212 | * | 10/2000 | Lang | 4/541.6 |

OTHER PUBLICATIONS

Waterway Plastics, Inc., "1999 Product Catalog" pages 7 and 8.
Waterway Plastics, Inc. "1999 Product Catalog" page 3.
Hydro Air Industries, Inc. (Model Nos. 10–2620 and 16–2620) (1998).

* cited by examiner

*Primary Examiner*—Charles E. Phillips
(74) *Attorney, Agent, or Firm*—Koppel & Jacobs

(57) ABSTRACT

A hydrotherapy jet system has a segmented outlet that extends from the jet body in response to a water flow through the jet and retracts when the flow stops. Water flows into the jet body, where it is directed into a nozzle that tapers to accelerate the water into a venturi jet that can then be aerated if desired. The water then enters the segmented outlet, which is urged to a retracted position within the jet body by a spring. The pressure from the water causes the outlet to extend from the jet housing against the spring pressure, compressing the spring. When extended, the outlet provides a stream of warm or aerated water to a reservoir such as a spa, pool or bathtub and the outlet can be manipulated to direct the stream. When the flow of water is stopped the spring expands and causes the outlet to retract into the jet body.

24 Claims, 6 Drawing Sheets

HYDROTHERAPY JET WITH AN EXTENDABLE/RETRACTABLE OUTLET

BACKGROUND OF THE INVENTION

1. Field of the Invention

This invention relates to hydrotherapy jets.

2. Description of the Related Art

Various hydrotherapy jets have been developed for use in spas, hot tubs, pools and bath tubs that discharge a stream of water which can be aerated through a variety of commercially available discharge nozzles. The various designs provide different flow characteristics which result in different massage affect being experienced by the body. Such jets have been found to produce a pleasing massaging effect for many users, and have become quite popular. In the design of single or multi-user spas or tubs, it is common to use a variety of different jet nozzles to provide a variety of different massaging effects.

Early jets simply discharged a steam of warm water with aeration if desired, along the longitudinal axis of the jet body. Since then, numerous jets have been developed in which the direction of the stream can be adjusted. For example, U.S. Pat. No. 5,269,029 to Spears et al. (assigned to the same assignee as the present invention) discloses a jet that provides an off axis stream of water and has an axial push/pull mechanism used to control the flow of water. The mechanism can also be rotated to rotate the stream of water around the jet axis, providing a limited directional control over the stream.

Other jets have been developed having fully adjustable directional outlets or eyeballs which are typically mounted in the face plate of the jet or recessed within the jet body. See Waterway Plastics Inc., "1999 Product Catalog," Page 7 and 8. The direction of the stream of water is adjusted by manually manipulating the nozzle or eyeball to the desired direction. While these jets provide greater freedom of adjustment, the jet housing interferes with and limits the range of off-axis adjustment.

Another disadvantage of conventional jets is that they cannot be adjusted to provide relief to the front of the body when the occupant is in the normal seated position. To obtain a flow of water to the front of the body or legs, the occupant must to turn his/her body to face the jet, resulting in an awkward and uncomfortable seating position. In addition, these jets are primarily designed to operate below the water level and provide limited relief to body parts above the water, such as the neck.

To provide greater freedom to direct the stream of water, hand held jets have been developed having a hose with an outlet at one end and the other end connected to the jet housing on the spa wall. See Waterway Plastics Inc., "1999 Product Catalog," Page 3. Within a range of the hose, the user can direct the stream of water to any part of the body, including the neck. One disadvantage of this jet is that it intrudes on the interior of the spa when not it use and can be an annoyance to or damaged by the spa occupants. In addition, it requires the occupant to hold the hose in place.

Jets have been developed by Hydro Air Industries Inc. (Model Nos. 10-2620 and 16-2620) that are installed above the water line and have an elongated outlet that is extended from the jet body and does not retract. The outlet can be manually bent, allowing the occupant to direct the outlet to the desired body part (such as the neck) and when released, the outlet will stay directed to the body part.

Because the outlet is extended from the jet body its adjustment range is not limited by the jet housing. However, because it stays extended whether the flow of water is on or off, it is often damaged by an occupant bumping into it when moving about the spa or when grasping it for balance or support when entering or leaving the spa.

SUMMARY OF THE INVENTION

The present invention provides a fully adjustable hydrotherapy jet having an outlet that extends from the jet body when the jet is on and retracts when it is off. The outlet is segmented so that it can be bent in different directions when extended, and has a tip that can be adjusted about the end of the outlet. The segments and tip allow the stream of water from the outlet to be directed to the desired location on the body.

The new jet can be used both above and below the water surface. Above the water surface it is particularly applicable to directing a stream of warm water to the neck area of the occupant. Below the water surface it provides a stream of aerated water and is particularly useful for providing relief to the front of the body and legs. The occupant can sit adjacent to the extended outlet of the new jet and it can be directed to provide relief to otherwise unreachable areas. Once the jet is directed to the desired area it can be released and will maintain its position.

The new jet system consists primarily of a jet body containing a nozzle, an escutcheon and the segmented outlet, all axially aligned within the jet body. Water from a spa or tub system is fed through a series of pipes to the jet body which in turn provides the water to the nozzle. The nozzle is tapered, creating a venturi which can be used to aerate the water. The escutcheon is positioned adjacent to and receives water from the nozzle. It has an axial cylindrical cavity containing the segmented outlet and a spring which urges the input of the outlet against the output of nozzle such that water leaving the nozzle enters the outlet. The pressure from the water forces the outlet to slide down the escutcheon cavity against the pressure of the spring, compressing the spring within the cavity. The outlet is extended from the jet body into the spa or tub providing a stream of water to the occupant that can directed to the desired body part.

The spa occupant can turn the jet off by rotating the escutcheon, which also rotates the nozzle. As the nozzle rotates, it slides toward the rear of the jet body where a sleeve overlaps the rear of the nozzle, cutting off the flow of water to the jet. When the water is no longer flowing in the jet, the compressed spring expands, retracting the outlet back into the escutcheon. To resume the flow of water and extend the outlet, the occupant turns the escutcheon the opposite direction.

These and other further features and advantages of the invention will be apparent to those skilled in the art from the following detailed description, taken together with the accompanying drawings, in which:

DETAILED DESCRIPTION OF THE INVENTION

A hydrotherapy jet with a self extendable/retractable outlet that is constructed in accordance with the invention is shown in FIGS. 1–4. The jet 10 and its components are preferably formed from a water impervious plastic such as ABS. It is particularly adapted to be positioned just above the water level or below the water level on the spa or tub wall, with a the majority the jet positioned behind the spa's water contacting wall. The jets water inlet is preferably directed vertically downward to receive a water supply tube from the rest of the spa's plumbing.

Figure 1:
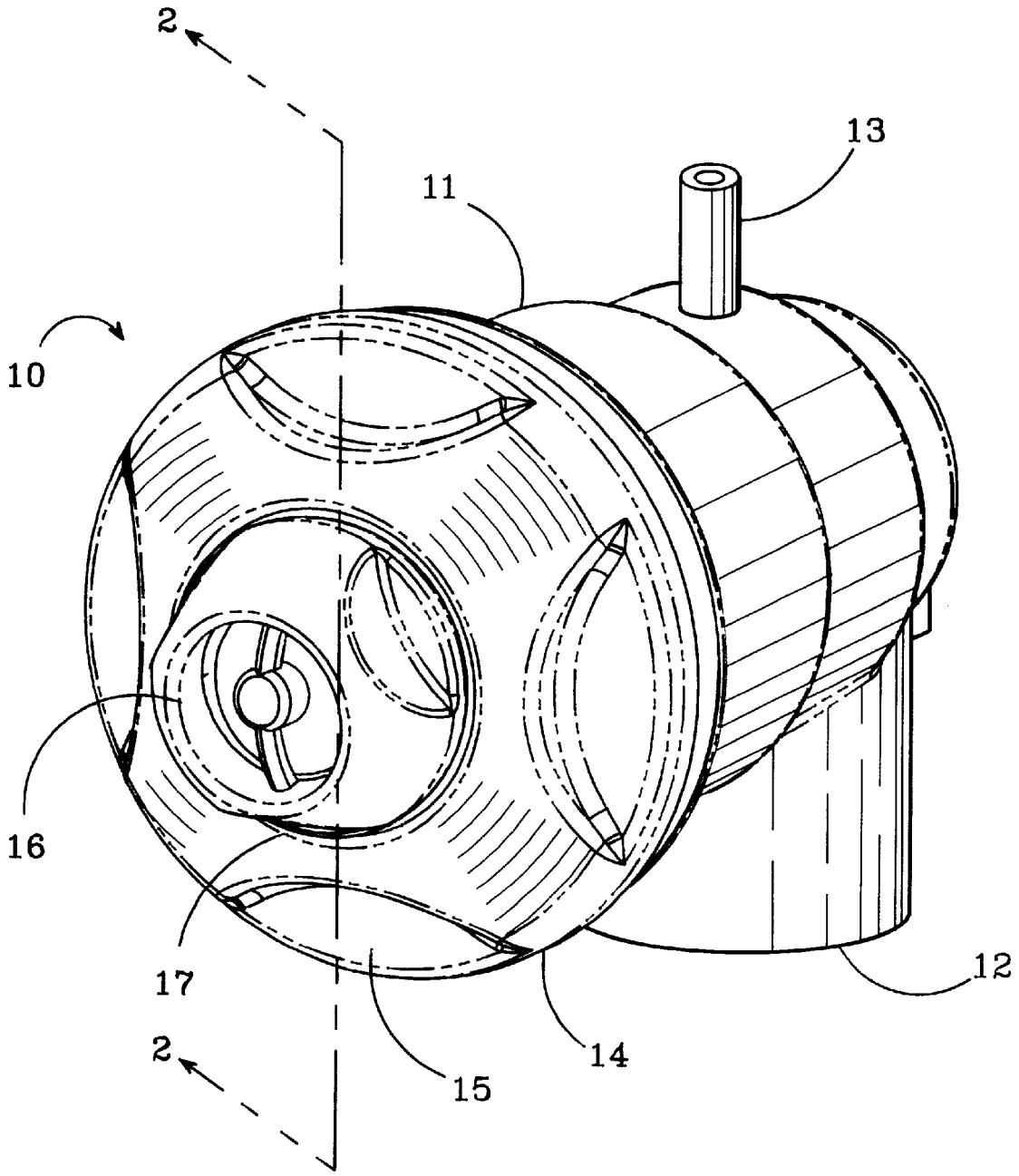
FIG. 1 is a perspective view of a the new hydrotherapy jet.

As shown in FIG. 1, the new jet 10 includes a jet body 11 having a water inlet pipe 12 that receives a standard water supply tube. The housing can also have an air inlet tube 13 to allow air into the jet body in applications where aerated water is desired. The jet body 11 contains an internal escutcheon having an external flange 14 that is positioned on the spa's water contacting wall. The flange 14 has a series of depressions 15 around its perimeter for gripping by the occupant to rotate the escutcheon and turn the flow of water in the jet 10 on or off. A segmented outlet is retracted into the escutcheon and only its outlet tip 16 is visible, resting within an axial depression 17 in the outer surface of the flange 14. The tip 16 is urged against the depression 17 by the pressure of an interior spring. In the retracted position, the outlet does not intrude on the interior of the spa and it is protected from damage.

Figure 2:
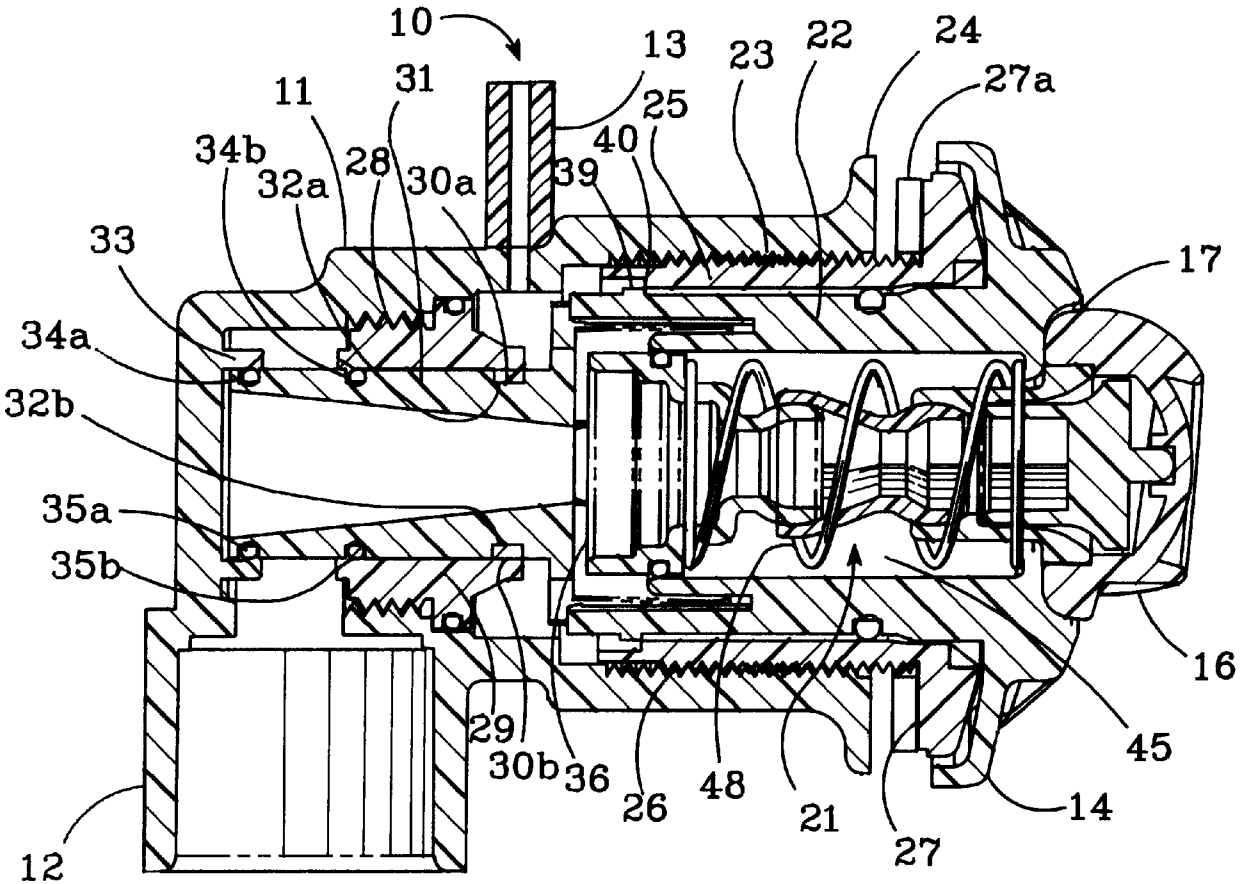
FIG. 2 is a sectional view of the new jet show in FIG. 1, taken along section lines 2—2.
Figure 3:
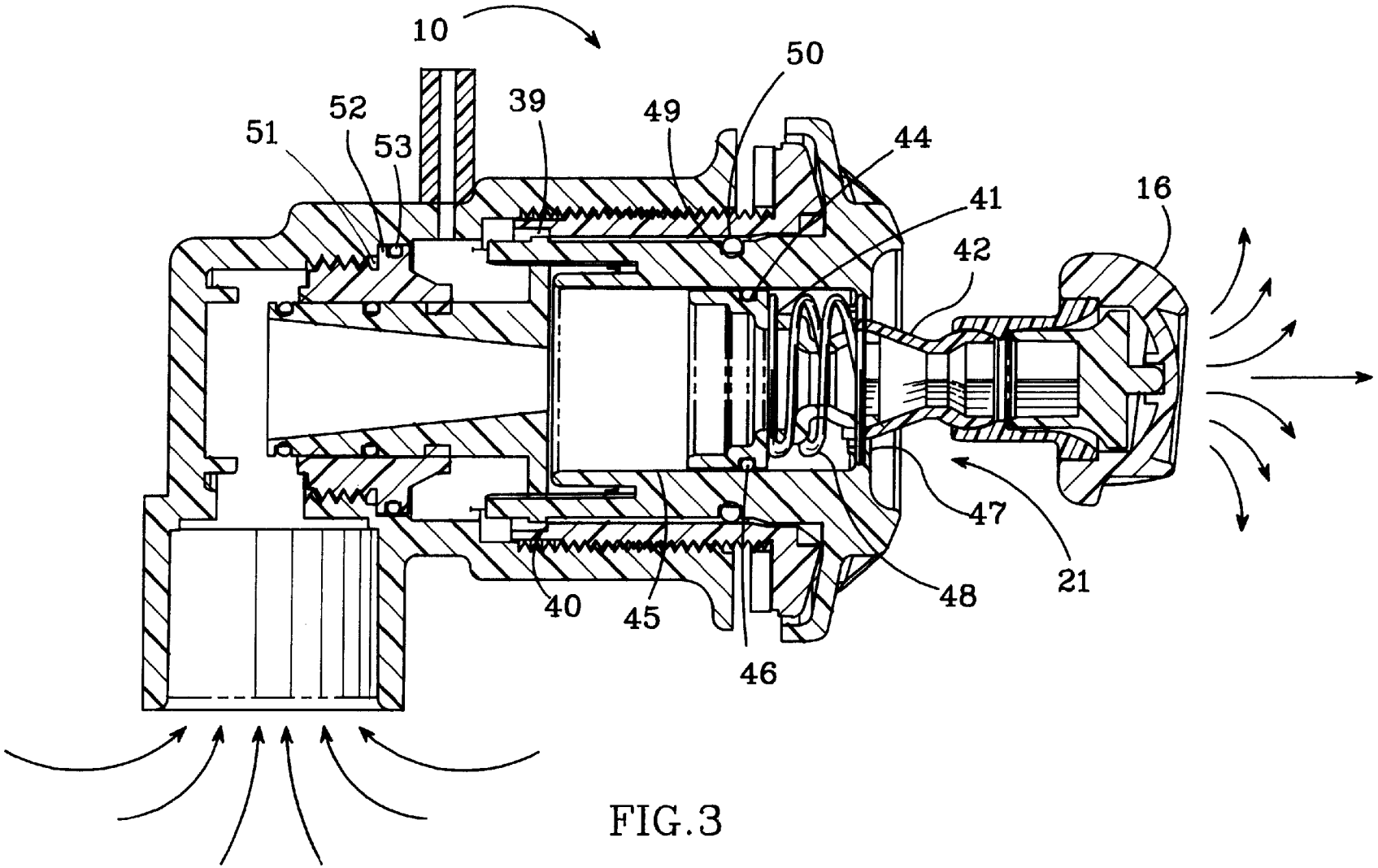
FIG. 3 is a sectional view of the new jet shown in FIG. 2, with the outlet extended.
Figure 4:
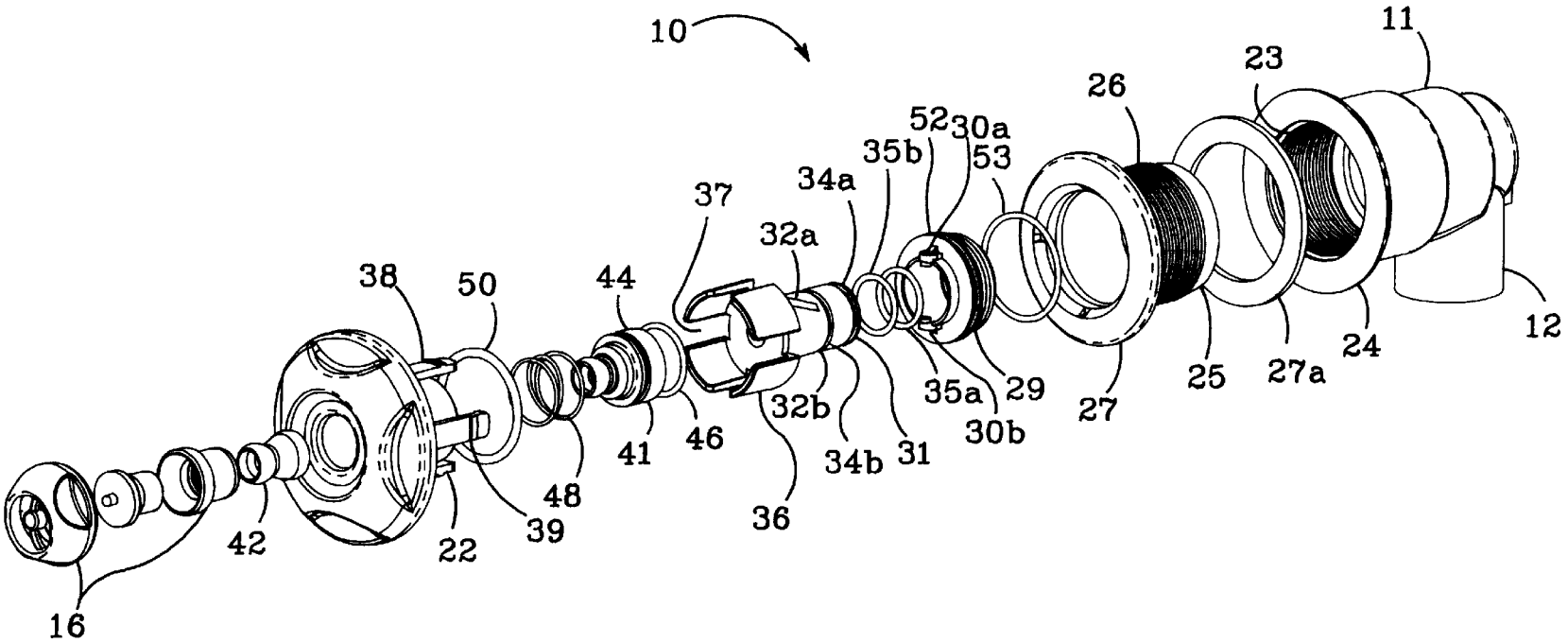
FIG. 4 is an exploded view of the new jet.

FIG. 2 shows the internal components of the new jet 10 when it is off, FIG. 3 shows the jet when it is on and FIG. 4 is an exploded view of the jet. In FIG. 2, water is not flowing through the jet 10 and the segmented outlet 21 is retracted into the escutcheon 22. The jet housing 11 has an interior threaded cavity 23 that opens toward the interior of the spa with a flange 24 at the forward end of the cavity 23. A wall fitting 25 includes a threaded tube 26 that is inserted from the interior of the spa through an opening in the spa wall, and threads into the cavity 23. The wall fitting 25 is screwed into the housing cavity until a flange 27 on the wall fitting 25 tightens against the spa wall. A circular gasket 27*a* is held on the wall fitting 25 to provide a seal between the flange 27 and the spa wall. The jet is held securely in place with the spa wall sandwiched between the cavity flange 24 and wall mounting flange 27.

Adjacent to the inlet pipe 12 the jet body has a second threaded cavity 28. A cylindrical retainer 29 having a threaded outer surface is threaded into the cavity 28. The retainer has a two tabs 30*a* and 30*b* on opposite sides that protrude toward the axial center of the jet body 11. A cylindrical nozzle 31 in positioned within the retainer and has two angled, longitudinal slots 32*a* and 32*b* on its exterior surface that mate with tabs 30*a* and 30*b*. When the nozzle is rotated about its axis within the retainer, the slots ride on the respective tabs to move the body forward or back in relation to the retainer 29 (depending on the direction of rotation).

The jet body 11 has an axially aligned cylindrical sleeve 33 projecting from the rear toward the interior of the spa. The diameter of the interior surface of the sleeve 33 closely matches the diameter of the exterior surface of the nozzle 31. The rear of the nozzle has two axial grooves 34*a* and 34*b*, into which O-rings 35*a* and 35*b* are seated. When the nozzle 31 is moved to the rear of the body 11, it is overlapped by sleeve 33 and O-ring 35*a* provides a seal between the sleeve 33 and the nozzle 31. At the same time, O-ring 35*b* provides a seal between the retainer 29 and the nozzle 31. In this position, water is blocked from entering into the nozzle 31 and the jet is off.

As shown if FIGS. 2 and 4, the nozzle also has wider diameter cylindrical mating section 36 at its forward end that has four equally spaced longitudinal notches 37. The escutcheon 22 has four longitudinal fingers 38 that mate closely with the longitudinal notches 37. When assembled, the fingers 38 are positioned within the notches 37, allowing the escutcheon and the nozzle to rotate in unison. When the occupant rotates escutcheon 22, the nozzle 31 also turns, which causes it to move forward or back on the tabs 30*a* and 30*b*. When the nozzle moves backward or forward, the mating section 36 slides on the fingers 38.

Each of the fingers 38 have a axial tab 39 that mates with an axial ledge 40 on the interior surface of the wall fitting 25. When the jet is assembled, the tabs 39 will engage the ledge 40, latching the escutcheon within the wall fitting while still allowing axial rotation of the escutcheon 22.

Referring now to FIGS. 3 and 4, the segmented outlet 21 comprises a piston 41, link 42, and tip 16, and it is housed within the interior cavity 45 of the escutcheon 22. The outlet can be made longer by adding more links or shorter by removing the link. The components of the outlet are press fit together and they can be rotated in relation to adjacent components. For example, the link 42 can be press fit over the rounded head of the piston 41 and it can be rotated about the rounded head. The friction between the two will hold the link 42 in the desired rotated position. The tip 16 has a sleeve 43 that can be press fit on and rotated about the rounded head of link 42. When it is extended, the components of outlet 21 allow it to be manually manipulated to direct the water flow to the desired location.

The base of the piston 41 fits closely within the interior cavity 45 and it has an axial groove 44 for a O-ring 46 which provides a seal between the piston 41 and the interior surface of the cavity 45. The cavity 45 has a axial lip 47 on its forward end and a spring 48 is retained between the lip 47 and the base of the piston 41. The spring urges the piston 41 to the rear of the cavity 45, thereby urging the segmented outlet 21 to its retracted position. When the jet is on and the outlet 21 is extended from the escutcheon 22, the spring 48 is compressed between the lip 47 and piston 41.

The surface of the escutcheon adjacent to the wall fitting has a axial groove 49 and an O-ring 50 that provides a seal between the escutcheon and the wall fitting. The exterior surface of retainer 31 has a cylindrical section 51 having a greater diameter than the remainder of the retainer allowing it to fit closely within the jet body 11. It has an axial grove 52 and O-ring 53 to provide a seal between the retainer 29 and jet body 11.

An air inlet tube 13 can be included to allow air to enter the jet body to aerate the stream of water. The interior surface of the nozzle tapers slightly to accelerate the water flowing through the nozzle, creating a venturi jet. There is a gap between the interior surface of the finger 38 and the notch 37, leaving a passageway through which air can flow to the forward end of the nozzle 31. At that location, the air is entrained into the water jet due to the venturi action, causing a desirable water/air mixture to be emitted from the jet. The design of nozzle 31 creating the venturi is determined by techniques known to those skilled in the art based on the geometric constraints of the system and the pressure and flow rate of the water entering into the system.

In operation, water enters the jet body 12 through the water inlet pipe 12. If the jet is off as is FIG. 2, the seal between the sleeve 33 and the nozzle 31, blocks the flow of water from entering the remainder of the jet body 11. To turn the jet on as shown in FIG. 3, the occupant grips the exterior flange 14 of escutcheon 22, rotating it (counter clockwise) until the flow of water begins. The fingers 38 of the escutcheon cause the nozzle to turn. When it turns, the action of the retainer tabs 30*a* and 30*b* and slots 32*a* and 32*b* cause it to move forward toward the interior of the spa. With this movement, the rear of the nozzle is removed from the sleeve 33 and water is allowed to flow past the sleeve into the nozzle.

The stream of water flows through the nozzle to an opening at its forward end and into the segmented outlet. The stream of water extends the segmented outlet from the escutcheon 11, compressing the spring 48, and water flows out of the outlet tip 43. With water (or aerated water) flowing from the outlet, the occupant can manipulate the nozzle to direct the flow.

To turn the jet off, the flange 14 is turned in the opposite direction (clockwise), which turns the nozzle 31 and causes it to move to the rear of the jet body 11 where the back of the nozzle 31 is overlapped by the sleeve 33. The seal between the sleeve 33 and the nozzle 31 blocks the flow of water into the nozzle 31 and outlet 21. The compressed spring 48 expands, retracting the outlet 21 into the escutcheon 22. The outlet piston 41 is urged to the rear of the escutcheon cavity 45 where the outlet 21 is fully retracted.

Although the new jet 10 is preferably operated in the on or off state, it can be used with an intermediate flow of water. If the escutcheon is rotated a fraction of the distance to turn the jet on or off, a smaller flow of water will be allowed to enter the nozzle 31 and outlet 21. If the flow of water does not provide sufficient pressure to extend the outlet, a flow of water may enter the spa without the outlet extending from the jet body 11.

Figure 5:
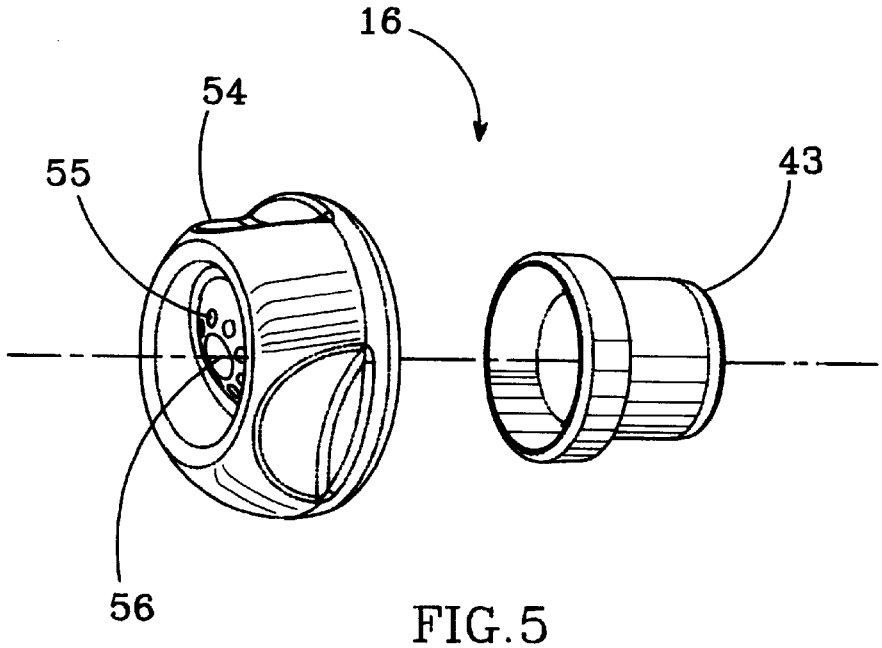
FIG. 5 is a perspective view of the slant outlet tip.
Figure 6:
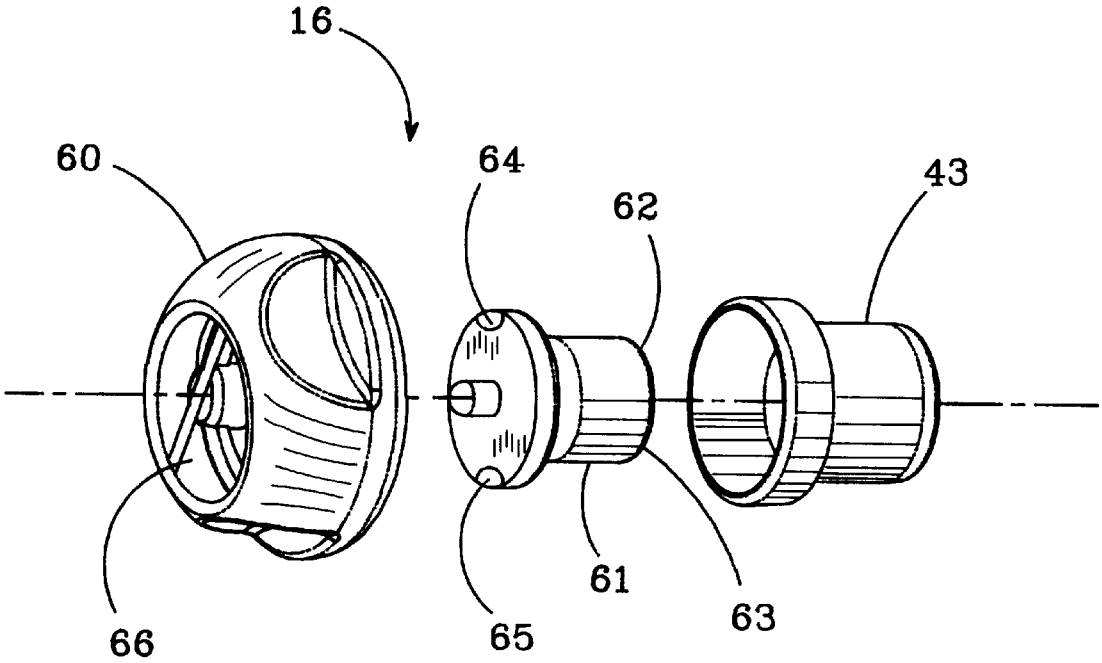
FIG. 6 is a perspective view of the pulsator outlet tip.

FIG. 5 and FIG. 6 show two preferred embodiments of the nozzle tip 16, although many different tips can be used. FIG. 5 shows a slant outlet 54 which has eight small holes 55 equally spaced in a circle surrounding a larger center hole 56. In tips with only one center hole, the stream of water expands as it moves away from the tip. By including the eight surrounding holes 55 the stream of water that does not expand as much as a single hole tip, providing a more concentrated stream which is particularly applicable to above water applications. The hole pattern is canted 20° within the tip 54 to direct the flow of the water down toward the surface of the water when the segmented nozzle extends, providing a stream of water directed down toward the occupants neck.

FIG. 6 shows a pulsating tip 16 which provides a pulsating stream of water from the tip outlet 60. The tip 16 contains a internal rotating cam 61 that is acted upon by the water flow. The cam has two input ports 62 and 63 and the water entering the cam 61 causes it to rotate. The cam also has two output ports 64 and 65 that provide two rotating streams of water. The tip has a cross beam 66 that extends across its output. As the streams rotate, they strike the cross beam which momentarily interrupts the streams, thereby providing a pulsating action. The cross beam 66 also provides a rotation point for the cam. Output tips 54 and 60 are bonded to a sleeve 43 to allow a press fit over the rounded head of the link 42.

Figure 7:
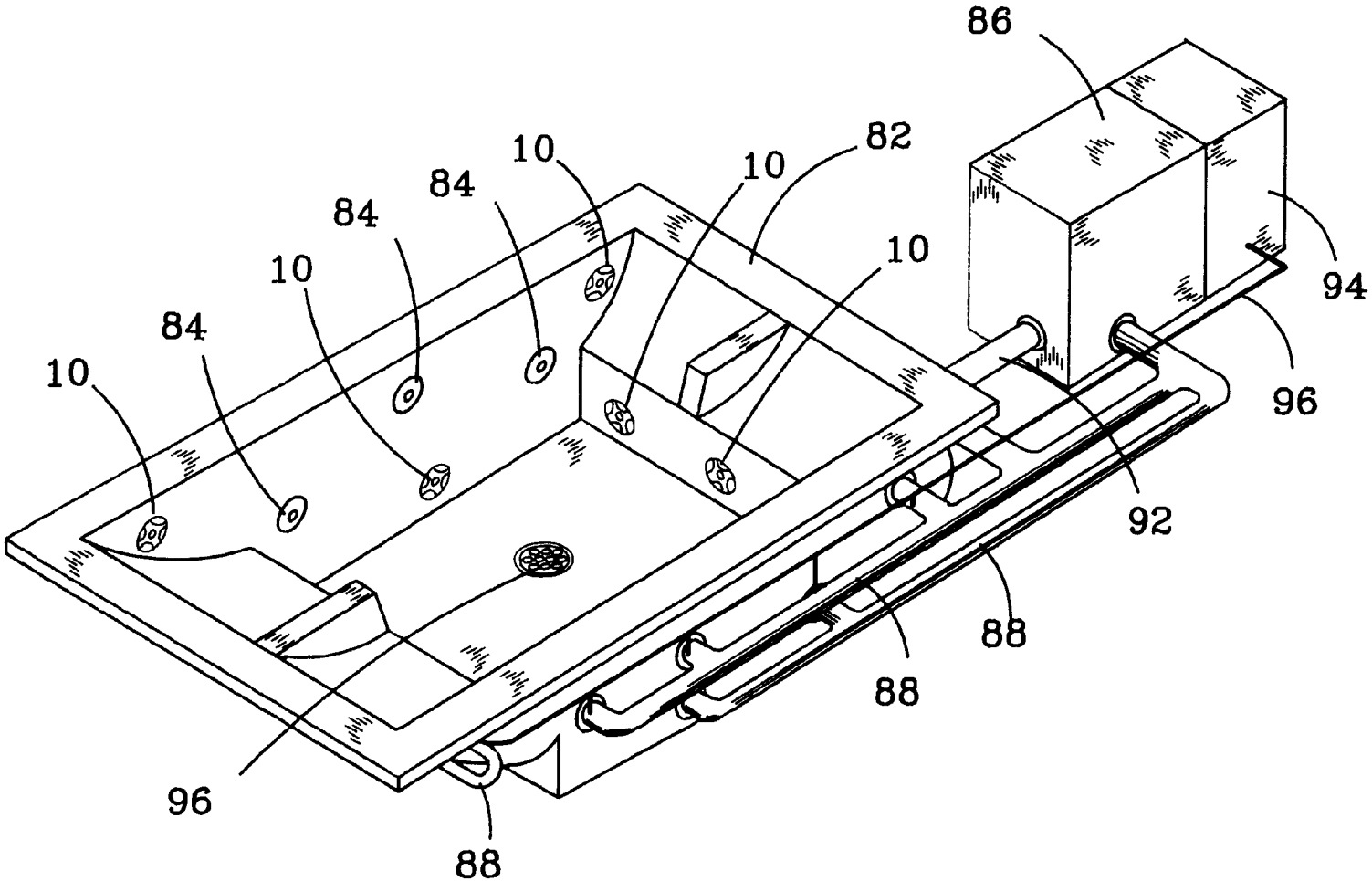
FIG. 7 is a perspective view of a spa/tub system using the new jet.

As shown in FIG. 7, multiple jets can be installed in a spa or tub shell 82 with all or some of the jets being jet 10. The remaining jets can be a variety of prior art single nozzle jets 84. Both types of jets are connected to a water pump system 86, used to circulate the water throughout the spa system, by a series of water conduits 88. Water from shell 82 is provided to pump 86 through drain 90 which is connected to return water conduit 92 on and in turn to pump 86. Water from pump 86 is provided back to shell 82 by conduit 88, where it flows into jets 10 and 84, as the case may be, and in turn into shell 82, completing the loop. Additionally, an air system 94 can be included that provides air to individual jets 10 and 84, by an air conduit 96, to aerate the water flowing through the jet. System 94 can be pump driven to increase the pressure of the air entering the jet, or the system can be vacuum based in which the venturi located within the jets draw the air into the jets and water flow stream.

Although the present invention has been described in considerable detail with reference to certain preferred configurations, other versions are possible. Therefore, the spirit and scope of the appended claims should not be limited to their preferred versions described above.

What is claimed is:

1. A system for providing a hydrotherapy jet to a reservoir of water, comprising:

a reservoir shell capable of holding water;

a plurality of extendable/retractable hydrotherapy jets mounted around the reservoir shell;

a water pump system that circulates water from said reservoir to said jets;

each of said jets having an outlet providing a stream of water when said water pump is operated, said outlet extending into said spa shell in response to a stream of water and retracting when the stream of water stops; and an air system that provides an air intake to each of said jets.

2. An extendable/retractable hydrotherapy jet system, comprising:

a jet body;

a water inlet to said body;

a water nozzle within said body for forming water flowing through said inlet into a stream;

an elongate water outlet having retracted and extended positions with respect to said body, said outlet extending from said body to said extended position in response to a stream of water from said nozzle and returning to said retracted position when the stream of water stops, said outlet having a plurality of segments, at least one of which rotatable about adjacent segments to direct the flow of water from said outlet.

3. The system of claim 2, wherein said outlet has a tip having at least one opening to allow water to pass and being rotatable about the end of said outlet to direct the flow of water from said outlet.

4. A system for providing a hydrotherapy jet to a reservoir of water, comprising:

a reservoir shell capable of holding water;

a plurality of extendable/retractable hydrotherapy jets mounted around the reservoir shell;

a water pump system that circulates water from said reservoir to said jets;

each of said jets having an outlet providing a stream of water when said water pump is operated, said outlet extending into said spa shell in response to a stream of water and retracting when the stream of water stops, each of said jets comprises:

a jet body;

a water inlet to provide circulating water to said body;

a water nozzle within said body for forming water flowing through said inlet into a stream; and said outlet housed within said body to discharge a stream of water from said nozzle into said reservoir;

each said outlet having a plurality of segments, each of which are rotatable about adjacent segments to direct the flow of water into said reservoir.

5. A system for providing a hydrotherapy jet to a reservoir of water, comprising:

a reservoir shell capable of holding water;

a plurality of extendable/retractable hydrotherapy jets mounted around the reservoir shell;

a water pump system that circulates water from said reservoir to said jets;

each of said jets having an outlet providing a stream of water when said water pump is operated, said outlet extending into said spa shell in response to a stream of water and retracting when the stream of water stops, each of said jets comprises:

a jet body;

a water inlet to provide circulating water to said body;

a water nozzle within said body for forming water flowing through said inlet into a stream; and said outlet housed within said body to discharge a stream of water from said nozzle into said reservoir;

said water nozzle forming a venturi and said body having an air inlet for aeration of water flowing through said nozzle.

6. A system for providing a hydrotherapy jet to a reservoir of water, comprising:

a reservoir shell capable of holding water;

a plurality of extendable/retractable hydrotherapy jets mounted around the reservoir shell;

a water pump system that circulates water from said reservoir to said jets;

each of said jets having an outlet providing a stream of water when said water pump is operated, said outlet extending into said spa shell in response to a stream of water and retracting when the stream of water stops, each of said jets comprises:

a jet body;

a water inlet to provide circulating water to said body;

a water nozzle within said body for forming water flowing through said inlet into a stream; and said outlet housed within said body to discharge a stream of water from said nozzle into said reservoir;

each said outlet having a plurality of segments, each of which are rotatable about adjacent segments to direct the flow of water into said reservoir and a tip having at least one opening to allow water to pass, said tip being rotatable about the end of said outlet to direct the flow of water from said outlet.

7. An extendable/retractable hydrotherapy jet system, comprising:

a jet body;

a water inlet to said body;

a water nozzle within said body for forming water flowing through said inlet into a stream;

an elongate water outlet having retracted and extended positions with respect to said body, said outlet extending from said body to said extended position in response to a stream of water from said nozzle and returning to said retracted position when the stream of water stops;

a spring within said body urging said outlet to its retracted position, wherein said spring is compressed when said outlet moves to its extended position; and an escutcheon within said body housing said outlet and spring, said escutcheon being rotatable to control the flow of water through said body.

8. The system of claim 7, wherein the rotation of said escutcheon causes said nozzle to rotate and move backward when the escutcheon is rotated in one direction, and to rotate and move forward when the escutcheon is rotated in the opposite direction.

9. The system of claim 8, wherein said body has a rear cylindrical sleeve, said nozzle engaging said sleeve when moved backward to control the flow of water through said body.

10. A system for providing a hydrotherapy jet to a reservoir of water, comprising:

a reservoir shell capable of holding water;

a plurality of extendable/retractable hydrotherapy jets mounted around the reservoir shell;

a water pump system that circulates water from said reservoir to said jets; and each of said jets having an outlet providing a stream of water when said water pump is operated, said outlet extending into said spa shell in response to a stream of water and retracting when the stream of water stops, said outlet being bendable to direct the flow of water from said outlet.

11. The system of claim 10, wherein each of said jets comprises:

a jet body;

a water inlet to provide circulating water to said body; and a water nozzle within said body for forming water flowing through said inlet into a stream; and an outlet housed within said body to discharge a stream of water from said nozzle into said reservoir.

12. The system of claim 11, further comprising a spring within said body urging said outlet to retract within said body.

13. The system of claim 12, wherein said spring is compressed when said outlet extends from said body.

14. A system for providing a hydrotherapy jet to a reservoir of water, comprising:

a reservoir shell capable of holding water;

a plurality of extendable/retractable hydrotherapy jets mounted around the reservoir shell;

a water pump system that circulates water from said reservoir to said jets;

each of said jets having an outlet providing a stream of water when said water pump is operated, said outlet extending into said spa shell in response to a stream of water and retracting when the stream of water stops, each of said jets comprises:

a jet body;

a water inlet to provide circulating water to said body;

a water nozzle within said body for forming water flowing through said inlet into a stream; and said outlet housed within said body to discharge a stream of water from said nozzle into said reservoir;

a spring within said body urging said outlet to retract within said body, said spring being compressed when said outlet extends from said body; and an escutcheon within said body housing said outlet and spring, said escutcheon being rotatable to control the flow of water through said body.

15. The system of claim 14, wherein the rotation of said escutcheon causes said nozzle to rotate and move backward when the escutcheon is rotated in one direction, and to rotate and move forward when the escutcheon is rotated in the opposite direction.

16. The system of claim 15, wherein said body has a rear cylindrical sleeve, said nozzle engaging said sleeve when moved backward to control the flow of water through said body.

17. An extendable/retractable hydrotherapy jet, comprising:

a jet body;

a water inlet to said body;

a water nozzle within said body for forming water flowing through said inlet into a stream of water, said nozzle tapering to form a venturi;

an escutcheon within said body and adjacent to said nozzle, the output of said nozzle entering said escutcheon;

an outlet and spring housed within said escutcheon, said outlet to discharge a stream of water from said nozzle, said outlet extending outward from said escutcheon in response to a stream of water from said nozzle and retracting when the stream of water stops, said spring urging said outlet to retract.

18. The jet of claim 17, wherein said outlet has a plurality of segments, at least one of which is rotatable about adjacent segments to direct a flow of water from said outlet.

19. The system of claim 18, wherein said outlet has a tip having at least one opening to allow water to pass and being rotatable about the end of said outlet to direct the flow of water from said outlet.

20. The jet of claim 17, wherein said body has an air inlet for aeration of water flowing through said nozzle.

21. The jet of claim 17, wherein said escutcheon is rotatable to control the flow of water within said body.

22. The jet of claim 17, wherein said escutcheon is rotatable to control the flow of water through said body.

23. The system of claim 22, wherein the rotation of said escutcheon causes said nozzle to rotate and move backward when the escutcheon is rotated in one direction, and to rotate and move forward when the escutcheon is rotated in the opposite direction.

24. The jet of claim 23, wherein said body has a rear cylindrical sleeve, said nozzle engaging said sleeve when moved backward to control the flow of water through said body.

* * * * *